US009447955B2

(12) United States Patent
Miller

(10) Patent No.: US 9,447,955 B2
(45) Date of Patent: Sep. 20, 2016

(54) LIGHTING ASSEMBLY FEATURING A PLURALITY OF LIGHT SOURCES WITH A WINDAGE AND ELEVATION CONTROL MECHANISM THEREFOR

(75) Inventor: Rodney H. Miller, Westmount (CA)

(73) Assignee: QUANTUM LEAP RESEARCH INC., Pointe-Claire (CA)

( * ) Notice: Subject to any disclaimer, the term of this patent is extended or adjusted under 35 U.S.C. 154(b) by 652 days.

(21) Appl. No.: 12/196,733

(22) Filed: Aug. 22, 2008

(65) Prior Publication Data

US 2009/0116231 A1 May 7, 2009

Related U.S. Application Data

(60) Provisional application No. 60/957,285, filed on Aug. 22, 2007.

(51) Int. Cl.

| | |
|---|---|
| ***F41G 1/35*** | (2006.01) |
| ***F41G 1/36*** | (2006.01) |
| ***F41G 11/00*** | (2006.01) |
| ***F21V 29/00*** | (2015.01) |
| ***F21V 17/02*** | (2006.01) |
| ***F21V 29/80*** | (2015.01) |
| *F21L 4/02* | (2006.01) |
| *F21Y 101/02* | (2006.01) |
| *F21Y 113/02* | (2006.01) |

(52) U.S. Cl.

CPC ..... *F21V 29/004* (2013.01); *F21V 17/02* (2013.01); *F21V 29/80* (2015.01); *F41G 1/35* (2013.01); *F41G 1/36* (2013.01); *F41G 11/001* (2013.01); *F41G 11/003* (2013.01); *F21L 4/027* (2013.01); *F21Y 2101/02* (2013.01); *F21Y 2101/025* (2013.01); *F21Y 2113/02* (2013.01)

(58) Field of Classification Search

CPC ..... F41G 1/35; F41G 1/36; F41G 11/001
USPC ..... 33/265, 229, 276–280, 286
See application file for complete search history.

(56) References Cited

U.S. PATENT DOCUMENTS

| | | | | |
|---|---|---|---|---|
| 4,904,081 | A * | 2/1990 | Miyahara | 356/141.3 |
| 5,223,909 | A * | 6/1993 | Cobb | 356/153 |
| 5,419,050 | A * | 5/1995 | Moore | 42/115 |
| 5,446,535 | A * | 8/1995 | Williams | 356/153 |
| 5,539,990 | A * | 7/1996 | Le | 33/283 |
| 5,782,003 | A * | 7/1998 | Bozzo | 33/291 |
| 6,195,902 | B1 * | 3/2001 | Jan et al. | 33/286 |
| 6,457,246 | B1 * | 10/2002 | Frazer et al. | 33/286 |
| 6,513,251 | B2 * | 2/2003 | Huang et al. | 33/286 |
| 6,532,675 | B2 * | 3/2003 | Letourneau | 33/277 |
| 6,751,879 | B1 * | 6/2004 | Pu | 33/286 |
| 7,487,596 | B2 * | 2/2009 | Nash | 33/290 |
| 7,679,845 | B2 * | 3/2010 | Wang | 359/822 |

* cited by examiner

*Primary Examiner* — Christopher Fulton
(74) *Attorney, Agent, or Firm* — BCF LLP

(57) ABSTRACT

The present invention relates to a lighting assembly having a principal light source, at least one secondary light source, and a focusing element adapted to focus light emanating from the principal light source and adapted to let light emanating from the at least one secondary light source pass through the focusing element. The invention also relates to a windage and elevation control mechanism having a longitudinal and lateral mobile unit and a receiving unit. The mobile unit is adapted to receive a device to be adjusted, and has two aligned protrusions located respectively on longitudinal opposite sides thereof. The receiving unit defines a cavity adapted to receive the mobile unit. The cavity is defined by facing surfaces having complimentary channels adapted to receive the protrusions of the mobile unit.

23 Claims, 14 Drawing Sheets

LIGHTING ASSEMBLY FEATURING A PLURALITY OF LIGHT SOURCES WITH A WINDAGE AND ELEVATION CONTROL MECHANISM THEREFOR

FIELD OF THE INVENTION

The present invention relates to the field of lighting assemblies. The light assembly disclosed herein features multiple directional light sources mounted on parallel axis. Furthermore, the present invention provides for a mechanism for conveniently correcting a light path of the lighting assembly.

BACKGROUND OF THE INVENTION

Typically, lighting assemblies feature a single light source. In such a typical lighting assembly featuring a directional or focused light source, the single light source is centrally located, and the light assembly has a cylindrical or other regular outer shape. Since the light output of a directional light assembly depends in part upon the size of its focusing element, whether a collimator or reflector, the focusing element will typically be as large as the inside diameter of the housing of the lighting assembly can accommodate.

Because of needs for flexibility, and space constraints, lighting assemblies featuring a plurality of different light sources in a single housing are desirable.

Lighting assemblies such as lasers are also used in conjunction with firearms to help an operator aim the firearm on a target. Typically, the laser is contained in a housing that is mounted to the firearm, in a manner where the laser is more or less parallel to a barrel of the firearm. Certain laser aiming devices are also featured on tactical flashlights, i.e. flashlights used in conjunction with firearms. It is often necessary to correct the aim of the laser beam for various reasons, including lack of parallelism with the barrel of the firearm and/or to compensate for the effects of gravity and crosswinds on the flight path of a bullet.

There is therefore a need for a light assembly that may contain different light sources within a single housing, and for which light path may be conveniently corrected.

SUMMARY OF THE INVENTION

The present invention is generally related to a lighting assembly including a plurality of light sources, and to a mechanism for adjusting a light path thereof.

In accordance with an aspect of an embodiment of the present invention, there is provided a lighting assembly. The lighting assembly comprises a principal light source, at least one secondary light source and a focusing element. The primary light source is capable of projecting light outwardly. The focusing element is adapted to focus light emanating from the principal light source and adapted to let light emanating from the at least one secondary light source pass there through.

In accordance with another embodiment, the present invention relates to a windage and elevation control mechanism comprising a longitudinal and lateral mobile unit and a receiving unit. The longitudinal and lateral mobile unit is adapted to receive a device to be adjusted, and has two aligned protrusions located respectively on longitudinal opposite sides thereof. The receiving unit defines a cavity adapted to receive the mobile unit. The cavity having facing surfaces with complimentary channels adapted to receive the protrusions of the mobile unit. The windage and elevation of the device is controlled by adjusting the mobile unit with respect to the receiving unit.

BRIEF DESCRIPTION OF THE DRAWINGS

In order to facilitate understanding of the present invention, the following Figures are provided with reference numerals in which similar references denote similar parts.

DETAILED DESCRIPTION OF THE INVENTION

Figure 1:
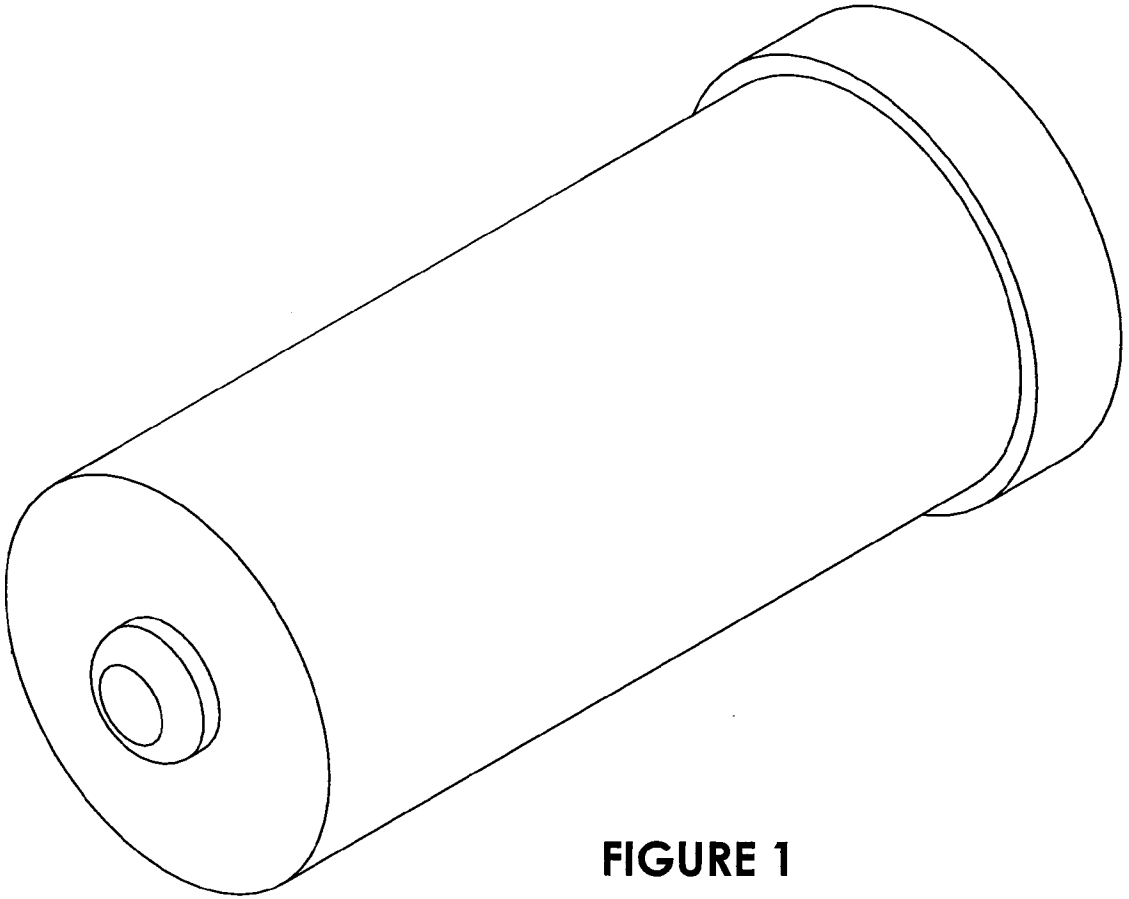
FIG. 1 is a side axonometric view of a lighting assembly in accordance with an aspect of the present invention.
Figure 2:
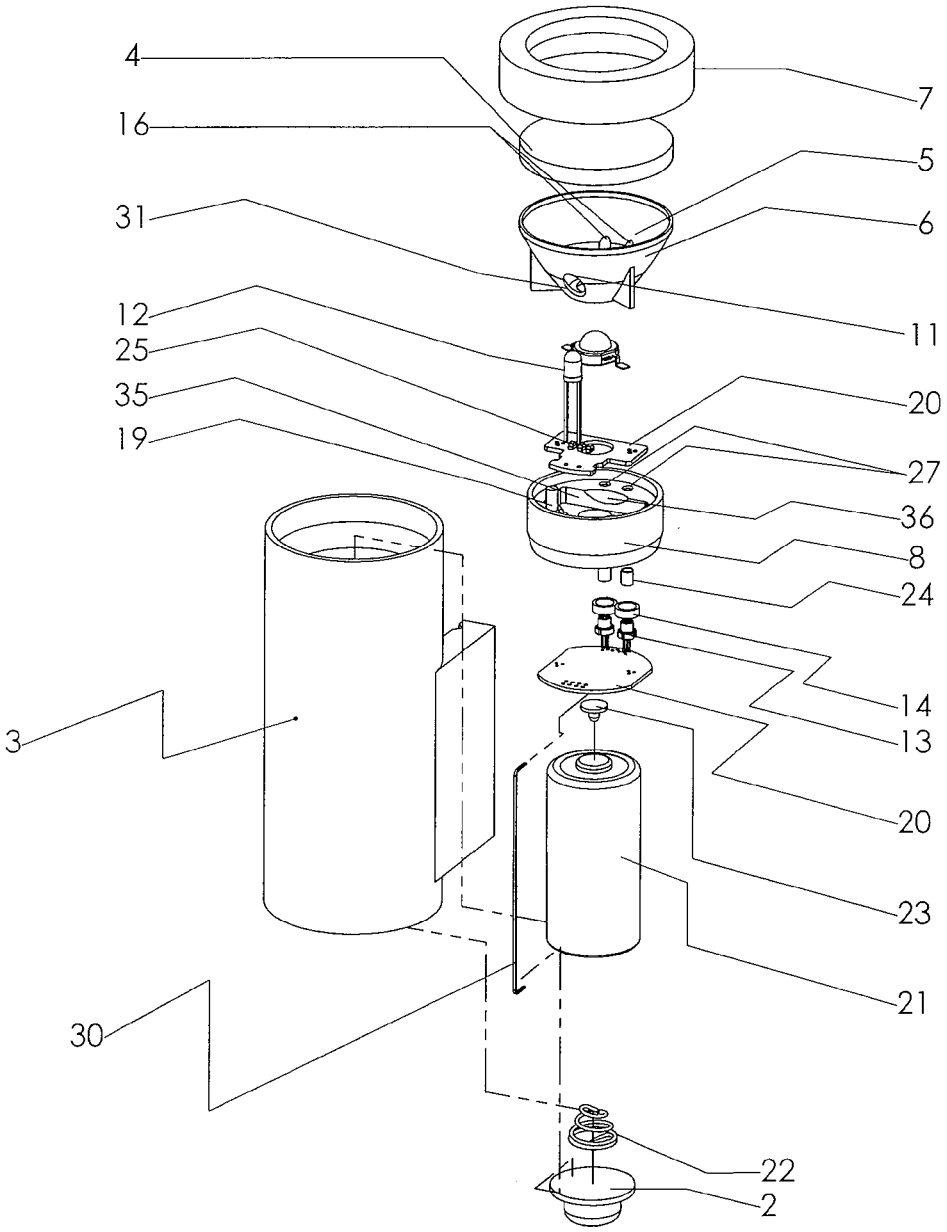
FIG. 2 is a side axonometric exploded view of an aspect of the lighting assembly of FIG. 1.
Figure 3:
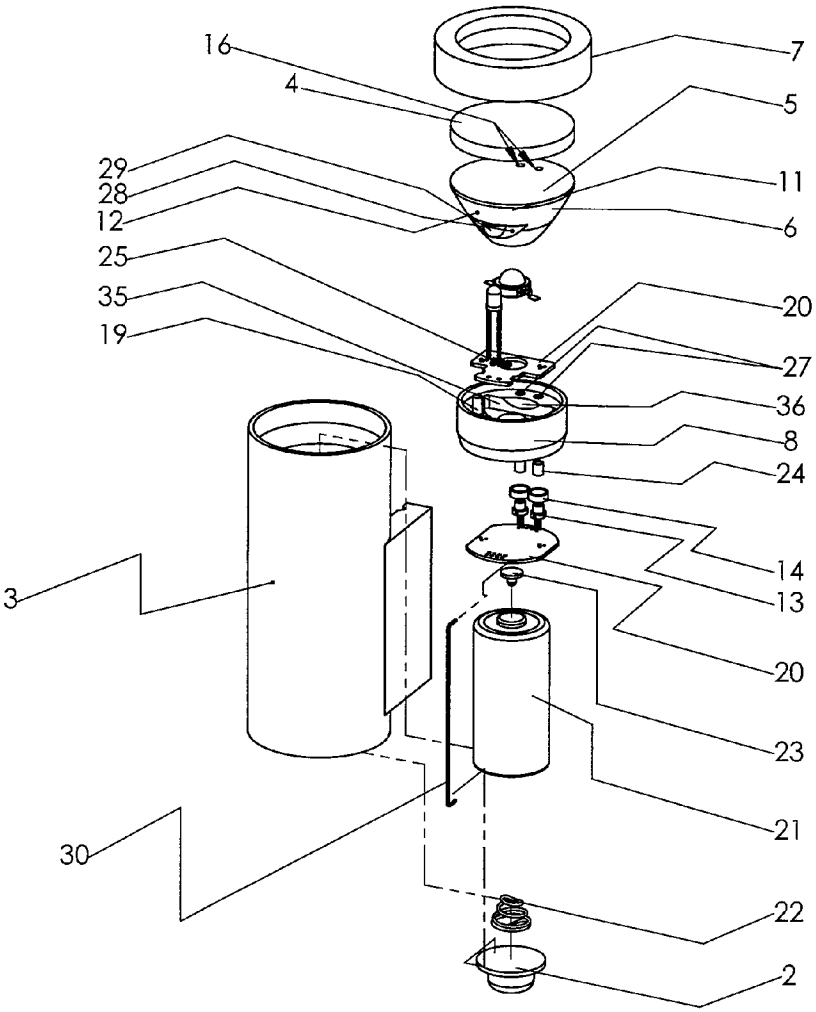
FIG. 3 is a side axonometric exploded view of another aspect of the lighting assembly of FIG. 1.

As shown on FIGS. 1, 2, 3, 8 and 9 the lighting assembly 1 of the present invention features a novel way of integrating multiple light sources 11/12/13 in a single housing 3, while maximizing the size of the focusing element 5/6 and the light output of a primary light source 11. In the lighting assembly 1 disclosed herein, secondary light sources 12/13, such as a peripheral laser 13 or peripheral LED 12 are positioned behind the focusing element 5/6, being either a reflector 6 or collimator 5 of the primary light source 11, and channels or apertures 16/17 in such focusing element 5/6 are used to transmit light from some of the secondary light sources 12/13, along an axis parallel to that of a beam generated by the primary light source 11.

In an embodiment of the present invention, the lighting assembly 1 is a portable lighting assembly such as shown on FIG. 1, also known as a flashlight. Also shown on FIGS. 2, 3, 4, 8 and 9 are various embodiments of the lighting assembly, featuring solid state light sources, such as laser diodes and Light Emitting Diodes (LEDs). The lighting assembly of the present invention lends itself to other embodiments, such as but not limited to non-portable lighting assemblies like helicopter search lights, headlights, signaling lights, and spotlights, as well as other types of light sources, such as incandescent tungsten, xenon and halogen light sources or any combination thereof. The light sources 11/12/13 may be either monochromatic or polychromatic.

The primary and secondary light sources 11/12/13 may be powered by either an external power source (not shown), or an integrated power source like a battery 21 or a plurality of batteries 21. The power source is electrically connected to the light sources 11/12/13 by way of conductive wiring 30, through a switch 2 or plurality of switches 2. When a single switch 2 is used, the single switch 2 is preferably a multimode switch. An electronic circuit board 20 is included in circumstances where the switch 2 is a multimode switch and/or at least one of the plurality of light sources 11/12/13 is a solid state light source, such as an LED.

Two preferred embodiments of the lighting assembly 1 are depicted in FIGS. 2, 3, 4, 8 and 9 each using different elements to focus the light of the primary light source 11, and of the secondary light sources 12. The first such preferred embodiment, as shown on FIG. 2, features a reflector 6 as a focusing element. The second such preferred embodiment, as shown on FIG. 3, features a collimator 5 as a focusing element. Examples of variations upon these preferred embodiments include the addition of a lens to the reflector 6, and the addition of an integrated mini collimator 29 to the collimator 5, as shown on FIG. 4.

Figure 4:
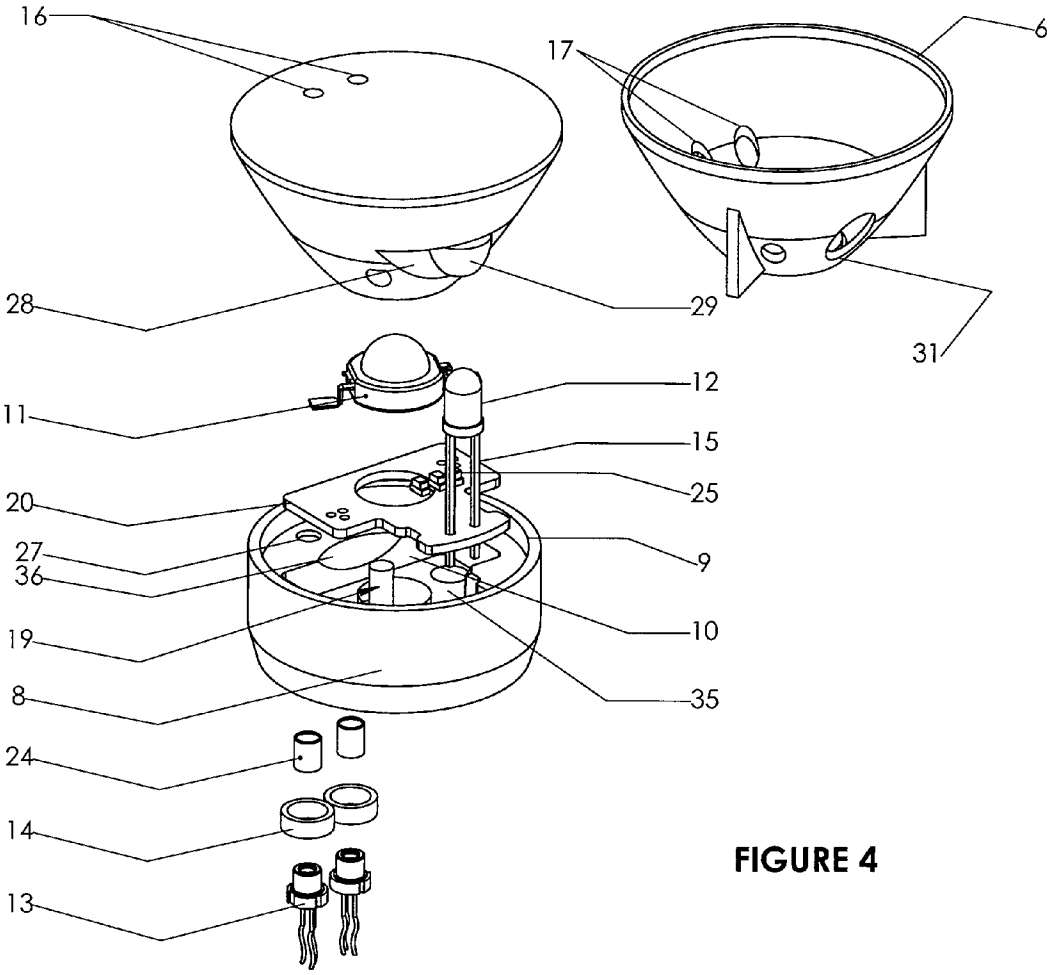
FIG. 4 is a side axonometric exploded view of a portion of the lighting assembly of FIG. 1.

The lighting assembly further comprises a single heat sink 8, which can be used to dissipate heat produced by one or the plurality of light sources 11/12/13, as shown on FIG. 4. The heat sink 8 preferably features a recess 35 to house a printed circuit board 20, which drives the plurality of light sources 11/12/13. Such recess 35 minimizes the amount of total space taken up by the assembly comprising the heat sink 8 and the printed circuit board 20. It further allows the heat sink 8 to be thicker outside the area of such recess 35, such that the heat sink 8 can better conduct and dissipate heat. The heat sink 8 serves a dual-purpose: in addition to its traditional role of dissipating heat generated by the light sources 11/12/13, it is also used as a mounting plate for some of the plurality of light sources 11/12/13. In view of the fact that the heat sink device may transmit heat from other light sources, such as the LED principal light source 11 to the secondary light source 13, an optional thermal insulator sleeve 14 is inserted in the heat sink 8, where each of the secondary light source 13 are to be mounted to the heat sink 8 to protect the potentially heat-sensitive secondary light sources 13 from thermal damage. The sleeves 14 are made out of a non-thermally conductive material. In the event that the primary light source 11 is a compact or low-profile LED such as, but not limited to, one of LUMILEDS' Rebel™, ultra-compact, surface mount, high-power LEDs, the edge of the circuit board recess 35 in a forward facing portion of the heat sink 8 may feature a bevel or series of bevels 36, as shown on FIGS. 2, 3, 4 and 6. Such bevels 36 allow positioning of the collimator 5 or reflector 6 closer to the LED principal light source 11, which in turn optimizes light output from such LED principal light source 11. An additional benefit of such bevels 36 is that they ensure proper positioning and centering of the collimator 5 or reflector 6, relative to the principal light source 11.

Another feature of the lighting assembly 1 disclosed herein is the presence of cylindrical channels 16 in the LED principal light source's 11 collimator 5 or apertures 17 in the reflector 6, depending on the preferred embodiment, to allow the light from some or all of the secondary light sources 12/13 to be emitted through the front portion of the lighting assembly 1 without deflection due to refraction.

As depicted in FIG. 4, in the version of the lighting assembly 1 featuring the collimator 5, the secondary light sources 12/13 may have their own collimator 29, or share the collimator 5 of the principal light source 11. The outside surface of the main collimator 5 may be shaped to form a protrusion, which acts as a secondary collimator 29 for the secondary light source 12, with an axis parallel to that of the main collimator 5.

A registration notch 18 on the collimator 5 or reflector 6, and corresponding registration tab 19 on the heat sink 8, ensure proper alignment of the channel 16 in the collimator 5 or aperture 17 in the reflector 6 with the multiple secondary light sources 12/13.

Alternatively, the registration tab 19 could be located on the collimator 5 or reflector 6, and the registration notch 18 could be located on the heat sink 8. The heat sink 8 preferably features a rim 9, which is wider than the thickness of the central part of the heat sink 8, in order to maximize the contact surface of the heat sink 8 with the housing 3 of the lighting assembly 1.

Alternatively, one or several of the secondary light sources 12/13 may also serve as the registration tab 18, engaging with the channel 16 provided on the collimator 5 or aperture 17 provided on the reflector 6 and ensuring appropriate positioning of the collimator 5 or reflector 6 relative to the plurality of secondary light sources 12/13.

Figure 6:
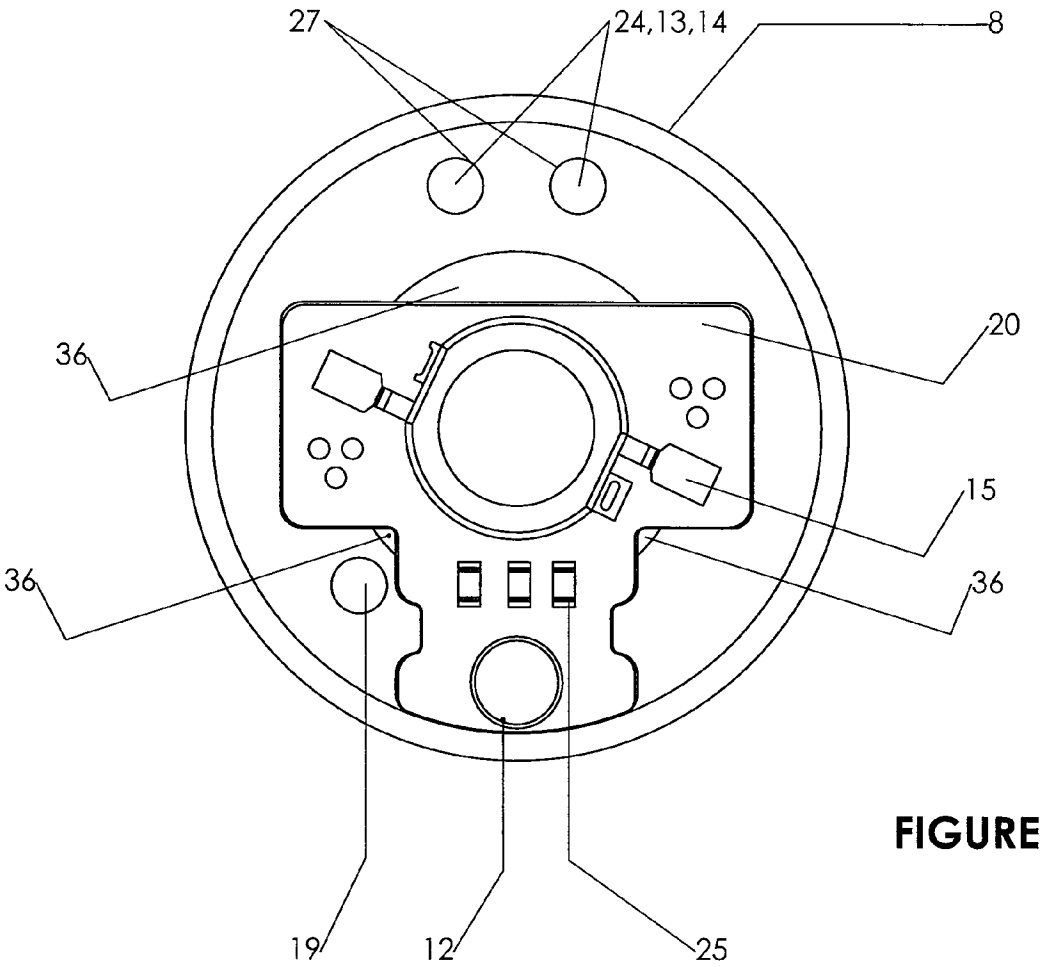
FIG. 6 is a top view of a portion of the lighting assembly of FIG. 2.

In another embodiment of the lighting assembly 1 shown on FIG. 6, there is a battery level indicator 25, comprising one or a plurality of low-power LEDs 26, which are preferably mounted on the circuit board 20 and activated through the switch 2. The low-power LEDs 26 allow monitoring of battery 21 level, and are visible through a lens 4 of the lighting assembly 1 shown on FIGS. 2 and 3. The plurality of low-power LEDs 26 may consist of an array of three low-powered LEDs 26, red, yellow and green in color, respectively indicating low, medium and high remaining battery run times.

Figure 5:
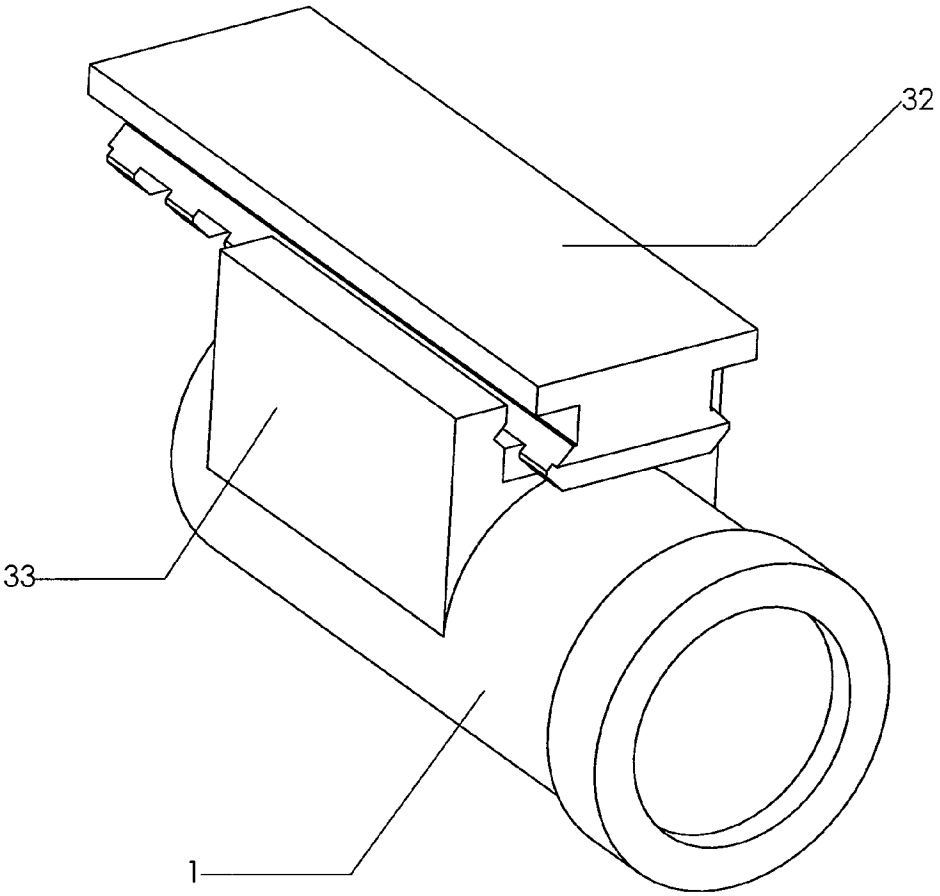
FIG. 5 is front axonometric view of a lighting assembly in accordance with aspect of the present invention, installed on a mounting mechanism.
Figure 7:
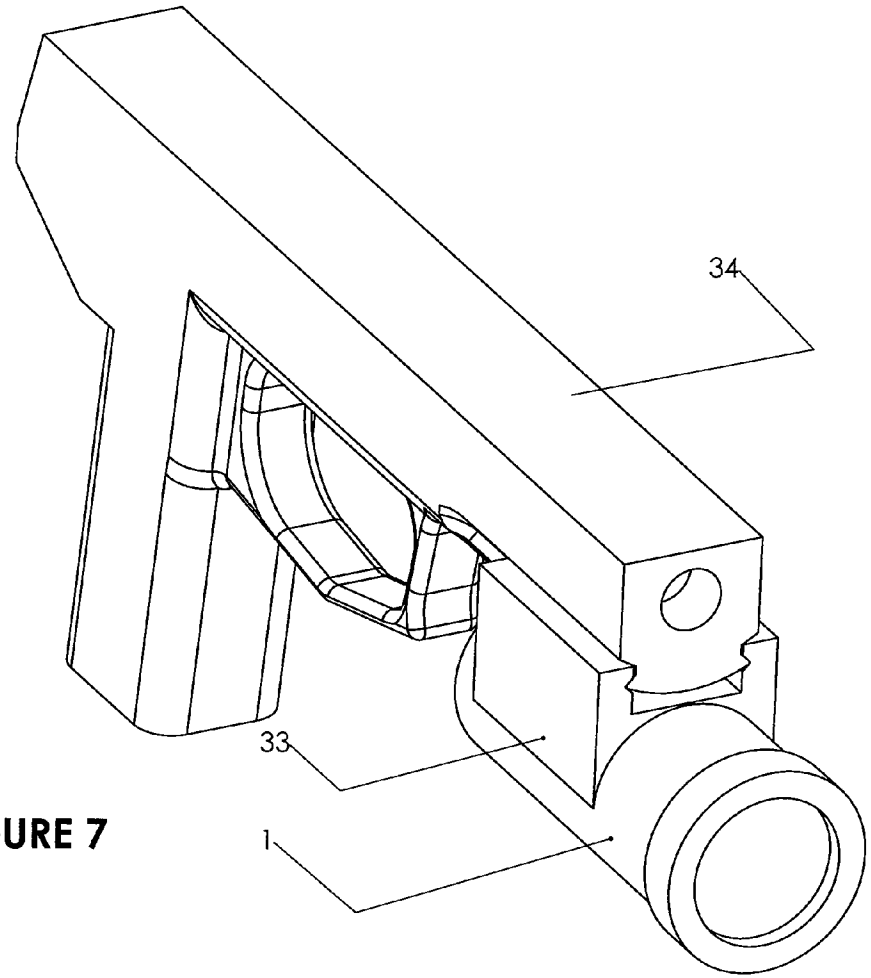
FIG. 7 is a front axonometric view of the lighting assembly of the present invention installed on a firearm.

The lighting assembly 1 can be further adapted for mounting on a device, object or structure, through the addition of a clamping or other mating mechanism 33 including, but not limited to, one that mates to a mounting rail 32, such as the one shown on FIG. 5, provided on such device, object or structure. An example of a device to which the lighting assembly 1 can be so mounted is a firearm 34, as shown on FIG. 7.

The lighting assembly 1 disclosed herein provides several advantages, including one or several of the following:

- the housing 3 of the lighting assembly 1 can be of cylindrical or other regular shape, without bulges or protrusions; not only is this esthetically more pleasing, but it also facilitates handling, holding, clamping and securing the lighting assembly 1;
- the focusing element for the primary light source 11 is of the maximum size that can be accommodated by an inside diameter of the housing 3 of the lighting assembly 1;
- the preferably cylindrical shape of the housing 3 facilitates its attachment to an object, device or structure; and when attached to an object, device or structure, through a clamp or other means of attaching the housing 3 to the object, device or structure, the preferably cylindrical shape of the housing 3 allows rotation of the housing 3 along its main axis, in order to position any of the secondary light sources 12/13 closer to or farther from the object, device or structure.

An illustration of this latter advantage is that when the lighting assembly 1 is mounted to the firearm 34 for use as a tactical light, the secondary light source such as a peripherally-mounted laser 13, used as an aiming device, can be positioned in such a way that it is closest to a barrel of the firearm 34, for maximum accuracy in aiming the firearm 34.

Turning now to FIGS. 8 through 11, there is shown a windage and elevation control mechanism in accordance with another aspect of the present invention. Although the Figures represent the windage and elevation control mechanism in connection with a laser, such representation is merely an illustration of a potential application and is not to be construed as restricting the field of use to lasers only. Besides lasers, the windage and elevation control mechanism may be used whenever one needs to aim a device in a particular direction with precision. Potential applications include, without limitation, artillery pieces, directional microphones, water jets, lighting apparatuses, communications antennas and transducers, etc. . . . .

For the purposes of describing the windage and elevation control mechanism, and the three dimensional aspects of same, reference will be made to the x, y, and z axis, where "x" is an axis that is parallel to the longitudinal axis of the housing (i.e. the direction of the light beam); "y" is a vertical axis perpendicular to x, when x is horizontal, and "z" is an horizontal axis, perpendicular to both x and y, when x is horizontal and y is vertical.

In a general manner, the windage and control mechanism of the present invention includes a longitudinal and lateral mobile unit 37, a receiving unit 8, and an adjusting mechanism 53/54. The longitudinal and lateral mobile unit 37 is adapted to receive a device (not shown) to be adjusted with respect to the receiving unit 8. For doing so, the mobile unit 37 has two aligned protrusions 40/41 located respectively on longitudinal opposite sides thereof. The receiving unit 8 defines a cavity adapted to receive the mobile unit 37. The cavity is defined by facing surfaces having complimentary channels 42/44 adapted to receive the protrusions 40/41 of the mobile unit 37. This combination of protrusions 40/41 of the mobile unit 37 and the complimentary channels 42/44 of the receiving unit 8 allows movement of the mobile unit 37 relatively to the receiving unit 8, which permits windage and elevation adjustment of the device by adjusting the mobile unit 37 with respect to the receiving unit 8. An adjustment retaining mechanism 50/53 is provided to facilitate and secure the movement of the mobile unit 37 with respect to the receiving unit 8.

Figure 10:
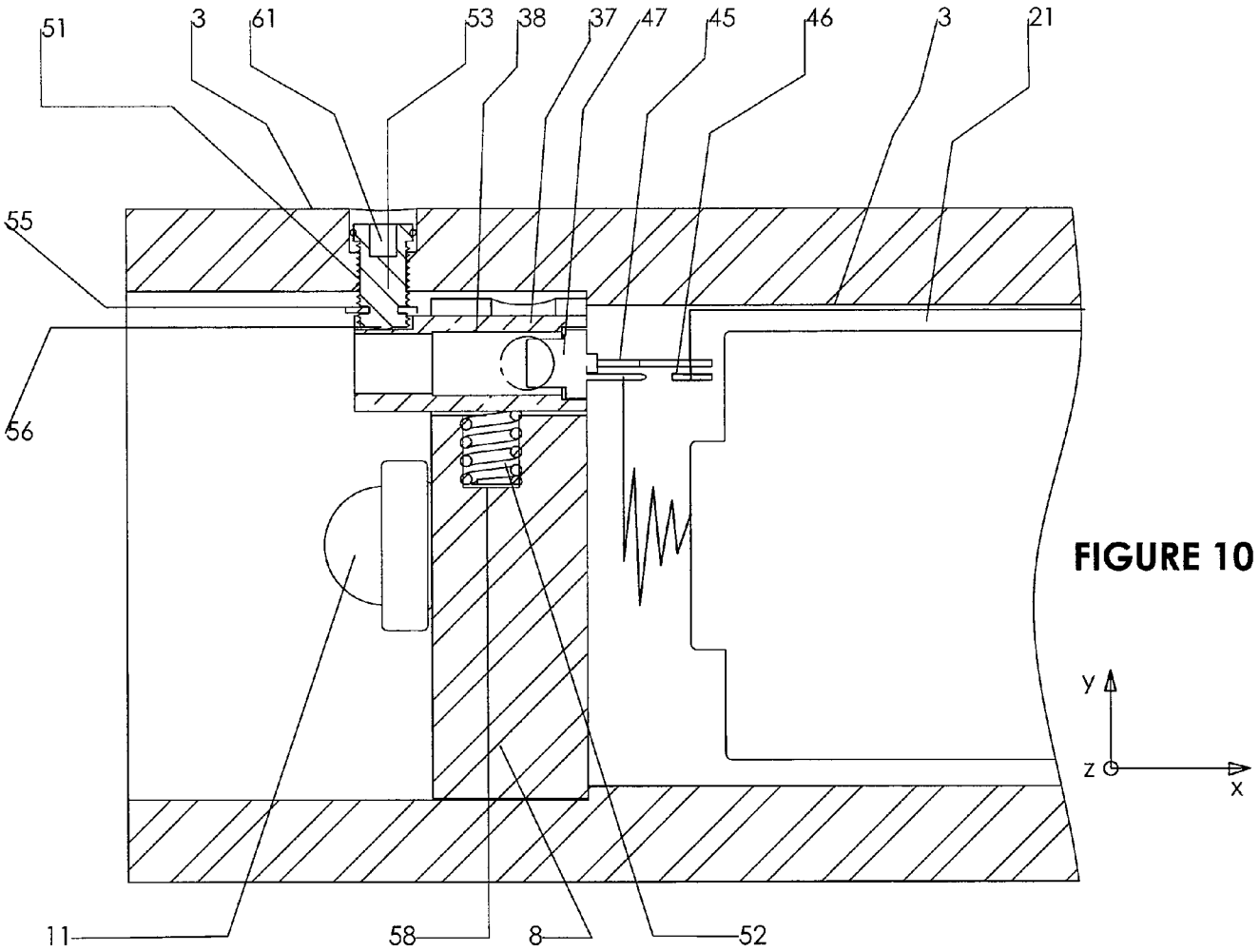
FIG. 10 is a partial cross-sectional view of the lighting assembly in accordance with another aspect of the present invention.
Figure 11:
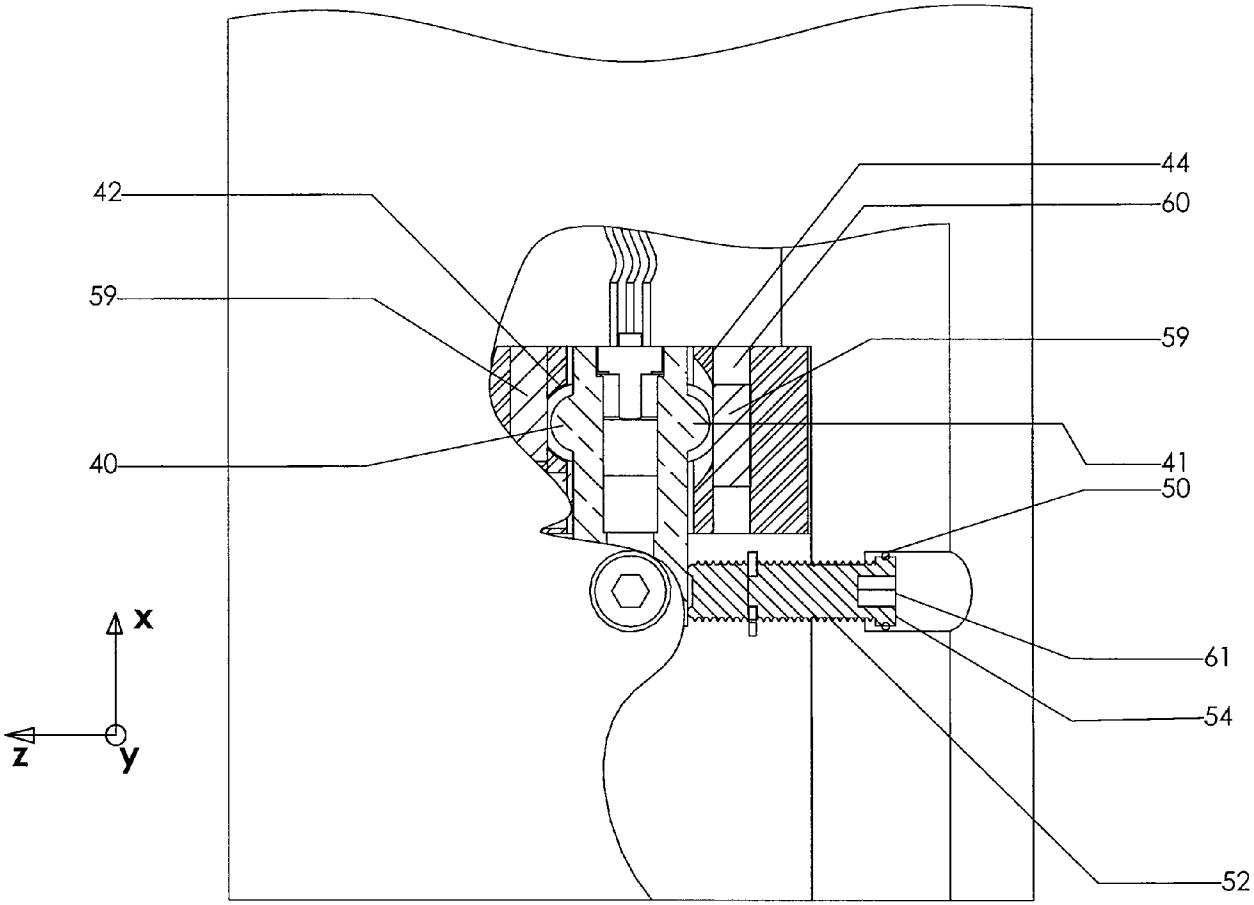
FIG. 11 shows a partial longitudinal cross-sectional top view of a windage and elevation adjustment mechanism of the lighting assembly in accordance with yet another embodiment of the present invention.
Figure 12:
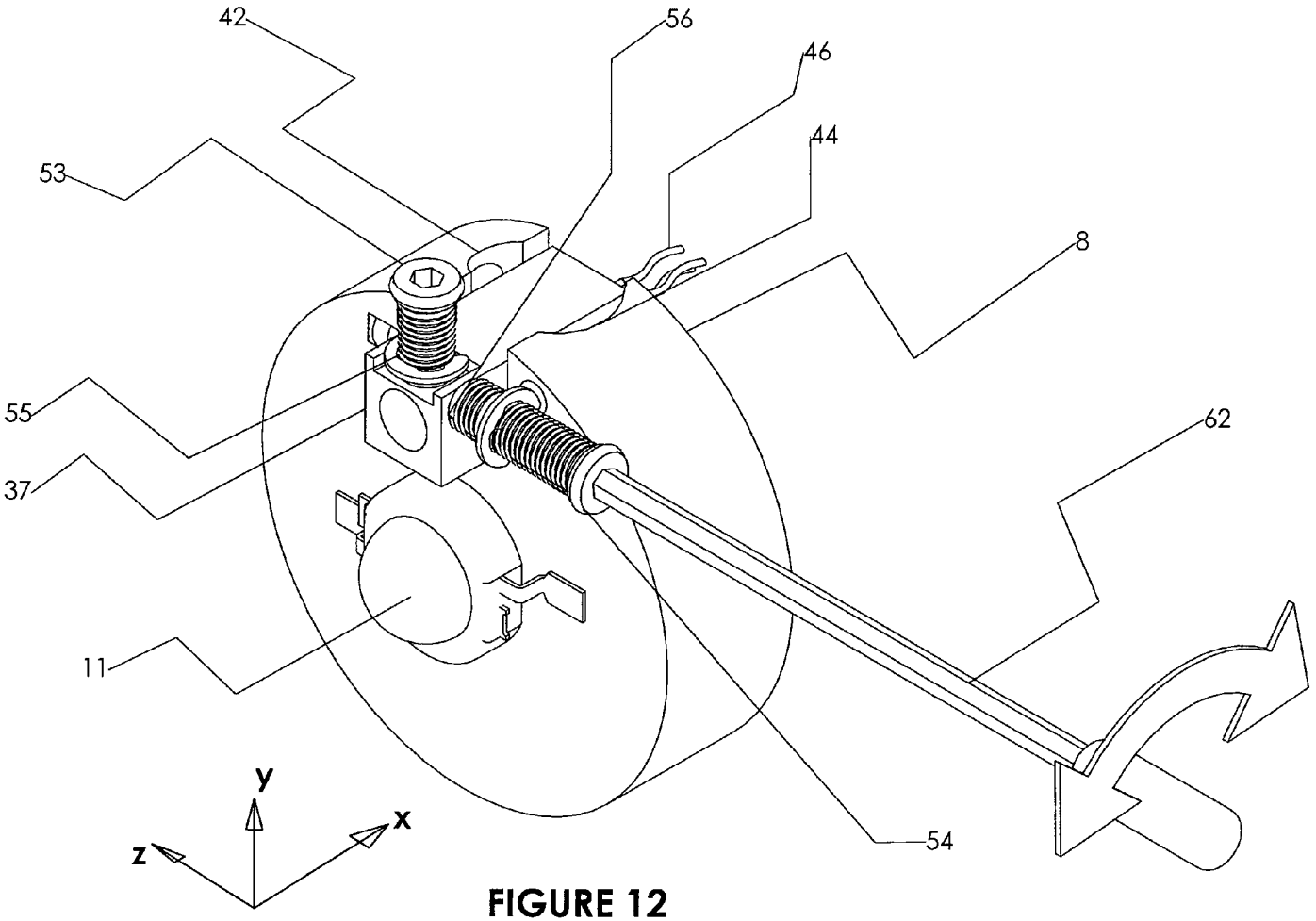
FIG. 12 is an axonometric view of the windage and elevation adjustment mechanism of the lighting assembly in accordance with the present invention.

Turning to FIG. 10, the mobile unit 37 is adapted to receive a device such as for example a laser, or a laser diode 47, and a focusing lens 4 (not shown for clarity purposes). The mobile unit 37 is positioned in such a way that a laser beam generated by the laser diode 47 is directed outwardly, through a front end of the mobile unit 37. If the laser diode 47 is to be positioned aft of the front end of the mobile unit 37, a bore 38 or barrel that is parallel to the x axis of the mobile unit 37 is provided to allow passage of the laser beam. The mobile unit 37 can be of any shape, provided that a portion of it extends away from the two protrusions 40/41, and that such extension features appropriately shaped, preferably flat contact areas at points of contact with the receiving unit 8 and the adjustment retaining mechanism 50/53, such as adjustment screws, described hereafter. In accordance with an embodiment, the mobile unit 37 has a square cross section, which inherently features such flat areas. The laser diodes 47 features connector leads 45, flexibly connected through connecting wires 46 to the printed circuit board 20 and connected to the electrical power source 21, through the switch 2. All of the aforementioned elements may be internal or external to the mobile unit 37. Although the position of the laser diode 47 may vary, in a preferred embodiment, the laser diode 47 is located near a rear end of the mobile unit 37 whilst the front end of the mobile unit 37 is open, to allow for passage of the laser beam. A lens (not shown) to focus the laser beam may be provided in the bore 38.

The mobile unit 37 is inserted in a cavity 39 of the receiving unit 8 that is adapted to receive the mobile unit 37. The cavity needs only to be large enough to receive the mobile unit 37, and allow for up and down (i.e. around the z axis) also called longitudinal movement, and side to side (i.e. around the y axis) movement also called lateral movement, to the extent required to effect the desired windage and elevation adjustments. In most tactical applications, a few degrees of range of movement are sufficient to achieve the desired adjustment.

In the preferred embodiment shown on FIGS. 10 to 14, the cavity is provided on the heat sink 8 device of the portable lighting assembly 1 and has a general direction parallel to the longitudinal axis (i.e. the x axis) of the lighting assembly 1.

Figure 13:
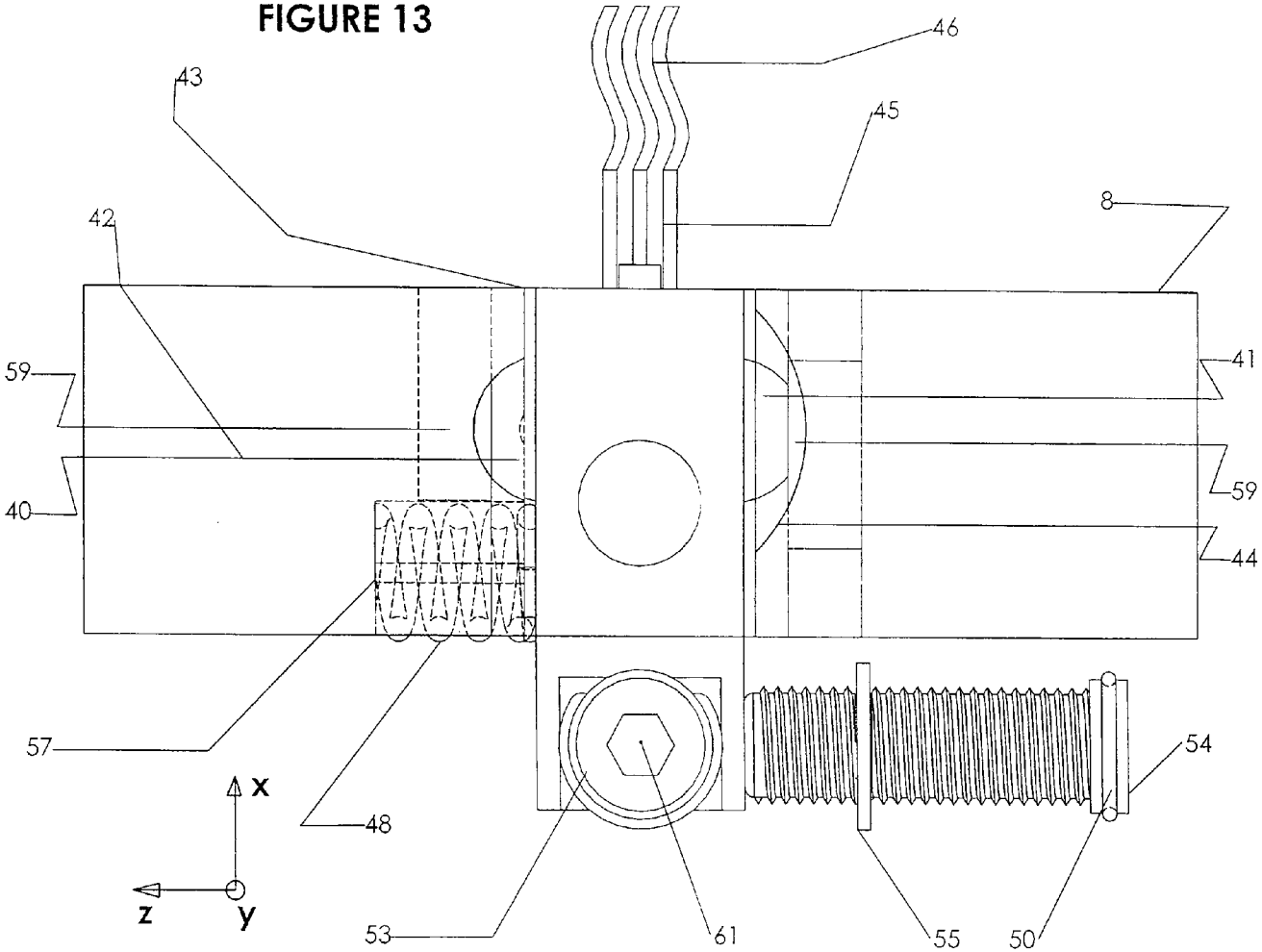
FIG. 13 is a top axonometric view and partial transversal cross-section, showing components of the windage and elevation control mechanism, in relation to a heat sink device of the lighting assembly.
Figure 14:
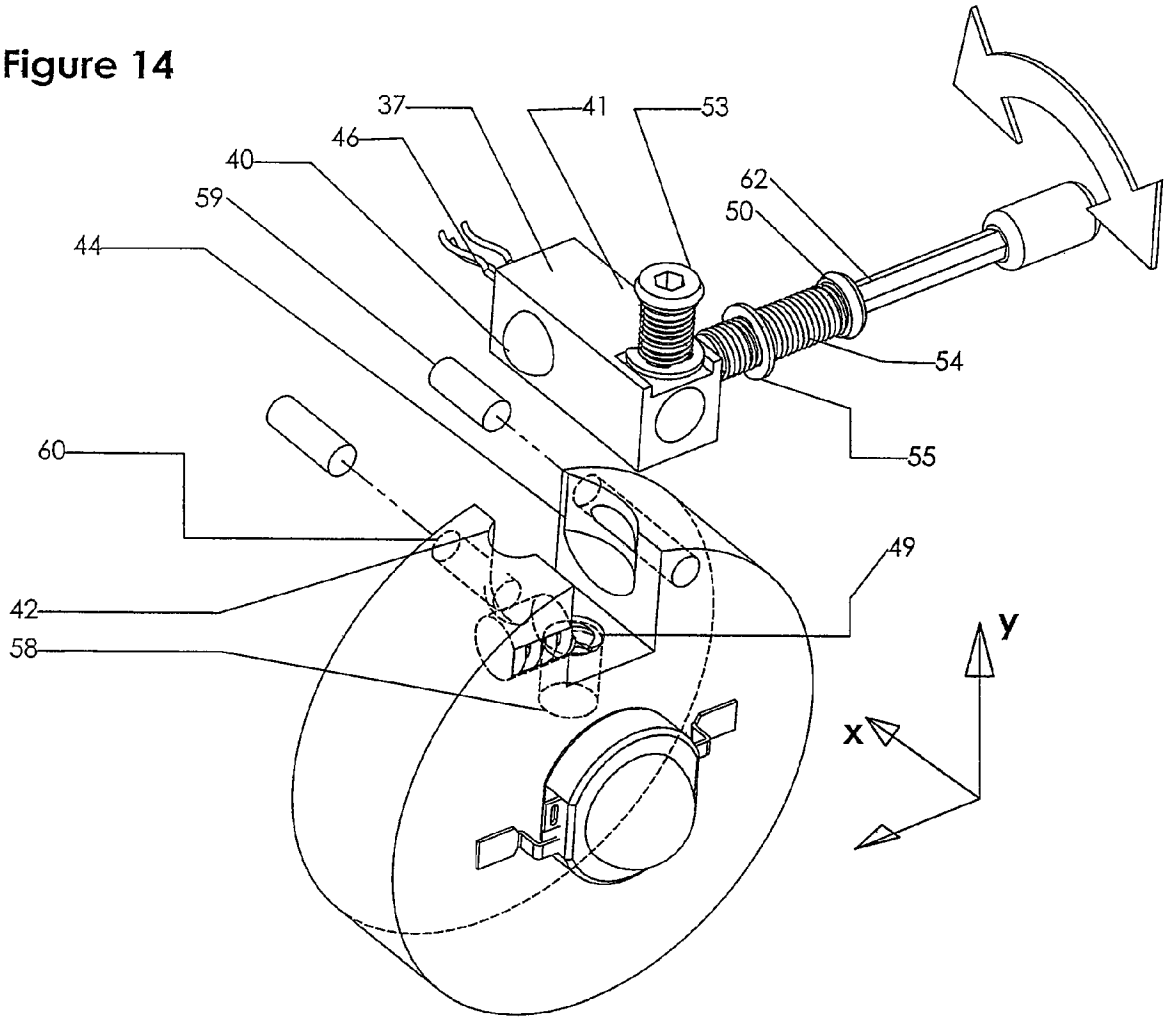
FIG. 14 is an exploded axonometric view of the windage and elevation adjustment mechanism of the light assembly in relation to the heat sink device.

The mobile unit 37 features two protrusions 40/41, located on opposite sides of the mobile unit 37. A tip of one such protrusion 40 (hereinafter called the first protrusion) is a partial sphere. In theory, the first protrusion could also be shaped as a cone, having a tip of infinitesimal dimension. However, any wear and tear of such tip would result in slop developing in the mechanism. Thus such a cone would, in fact, have a spherical tip of infinitesimal or quasi-infinitesimal radius. The tip of the protrusion 41 (hereinafter referred as the "second protrusion") has a circular cross section, relative to the z axis. In accordance with an embodiment of the present invention, as shown in FIG. 13, an imaginary line traversing an apex of the two protrusions 40/41 is parallel to the z axis of the mobile unit 37. Each respective protrusion 40/41 fits into a corresponding socket 42/44 provided on opposite sides of the cavity 39. One such socket (the "first socket") 42 has a shape adapted to receive the first protrusion, and to allow movement of the first protrusion within the first socket around the z and y axis, but not around the x axis. In order to achieve the desired range of movement, whilst ensuring retention of the first protrusion within the first socket, a minimum of three points of contact must exist between the first socket (and/or a dowel, whenever one is provided) and the spherical tip of the first protrusion. By way of example, the shortest possible arc linking the three points of contact along a surface of the first protrusion must be of at least 180 degrees, to ensure that the first protrusion is retained within the first socket.

To facilitate the insertion of the mobile unit 37 into the cavity 39 of the receiving unit 8, the first socket 42 may be open on one side. A dowel pin 59 is then inserted in a dowel hole 60 located adjacent to the respective socket 42, thus preventing the first protrusion 40 from exiting the socket 42, while allowing movement within the same.

The second such socket (the "second socket") 44 is a curved channel, oriented in the x-z plane. It is shaped so as to allow rotation of the mobile unit 37 around the z axis, and movement along its length, in the x-z plane, whenever the mobile unit 37 is being rotated around the z axis. The curvature radius of the curved channel is such that a minimum of two points of contact are maintained throughout the range of motion between the spherical tip of the second protrusion, and the second socket (and/or dowel, as the case may be).

As with the first socket 42, the second socket 44 may be open to one side, to allow for the easier insertion and proper positioning of the mobile unit 37 into the cavity 39 of the receiving unit 8. Similarly to the first socket 42, a dowel pin 59 is inserted in a dowel hole 60 located adjacent to the second socket 44, preventing the second protrusion 41 from exiting the second socket 44, while allowing travel along the length of the curved channel 43 forming the second socket 44.

In order to effect windage and elevation adjustment, one needs to provide means to transmit force in order to move the mobile unit 37, means to counteract such force via elastic deformation, and means to immobilize the mobile unit 37, in order to retain the desired setting. Many solutions are possible. Possible means to transmit force include the use of a screw, a rod, of an inflatable bladder or of hydraulics. Counteracting that force through elastic deformation may be achieved through any material or device that may undergo elastic deformation, such as a spring, an elastomer, memory foam, or even a gas filled bladder. In the preferred embodiment described herein, adjustment screws and coil springs are used.

Figure 8:
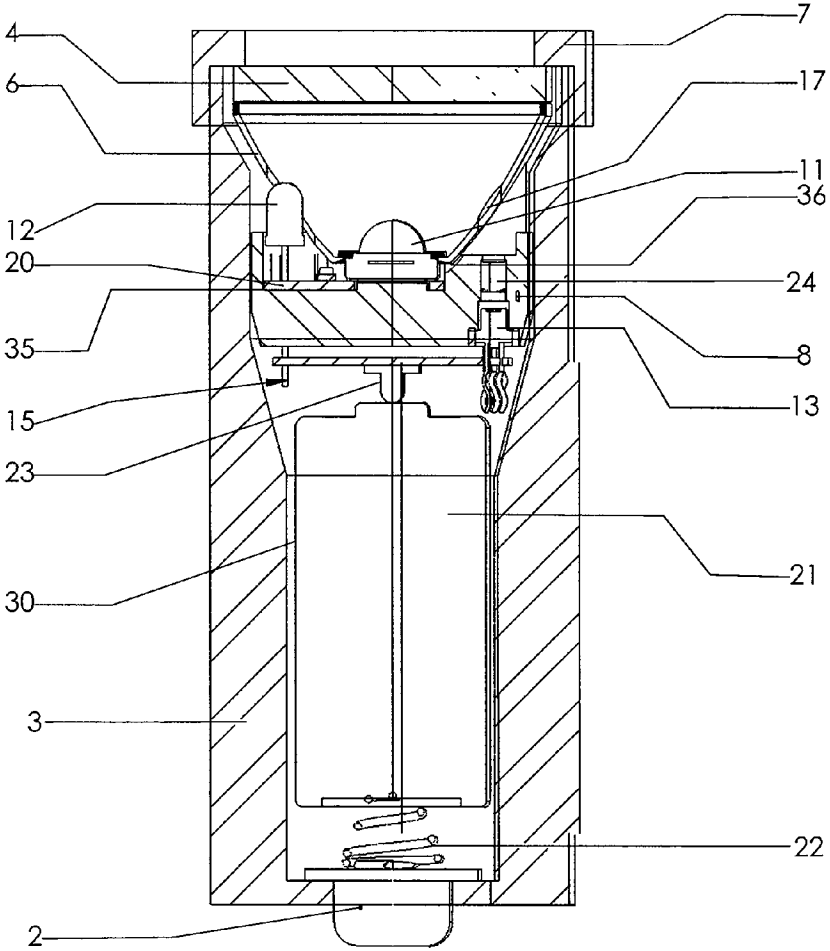
FIG. 8 is a side cross-sectional view of the lighting assembly in accordance with an aspect of the present invention.
Figure 9:
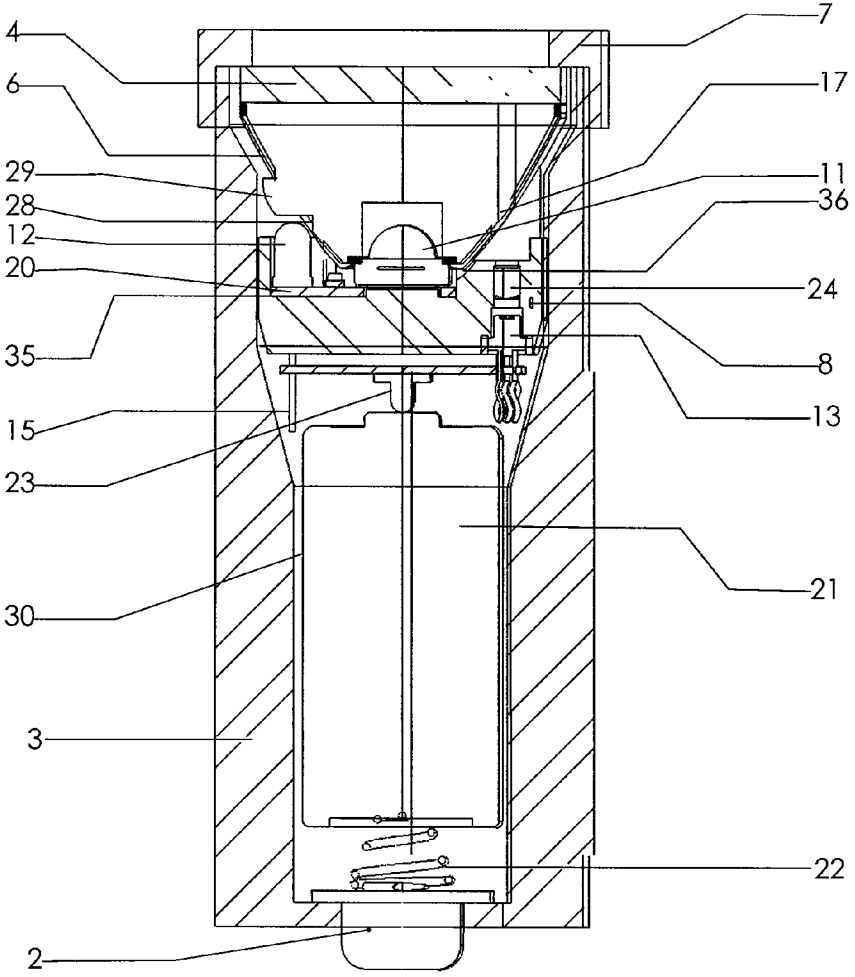
FIG. 9 is a side cross-sectional view of the lighting assembly in accordance with another aspect of the present invention.

As previously mentioned and as shown on FIGS. 8 and 9, in the preferred embodiment disclosed herein, the housing 3 of the lighting assembly 1 has a regular shape, such as a tubular shape. The inside diameter of the bore 38 corresponds to the outside diameter of the heat sink 8. The heat sink 8 is inserted inside the housing 3 and held in place therein. As shown in FIG. 10, a sidewall of the housing 3 features two threaded holes 51/52, perpendicular to one another. In the preferred embodiment disclosed herein, one such hole is parallel to the y-axis, and the other is parallel to the z-axis thereof. Both holes 51/52 intersect the x-axis of the mobile unit 37 at a point, which is located away from the protrusions 40/41 and the sockets 43/44. Each such hole is threaded in order to receive a corresponding adjustment screw 53, preferably featuring a head 63 and socket 61 to receive a tool 62 allowing for rotation of the adjustment screw 53. Although a head, socket and tool are contemplated, other solutions, such as a crank handle, are possible. When inserted into the respective holes 51/52, each of the adjustment screws 53/54 rests against the outside wall of the mobile unit 37. The combined effect of rotating of the respective adjustment screws 53/54 towards or away from the mobile unit 37, and the counteracting force of the springs result in movement of the mobile unit 37 within the cavity 39. The adjustment screw 53 located in the y-axis (when the mobile unit 37 is in the neutral position) controls elevation of the laser beam by rotating the mobile unit 37 around an axis passing through the respective apex of the two protrusions 40/41 (i.e. the z axis). The screw located in the z axis (when the mobile unit 37 is in the neutral position) 54 controls windage of the laser beam by rotating the mobile unit 37 around a point that is the notional center of the spherical tip of the first protrusion 40. On the opposite side of each screw hole, but not necessarily directly opposite such screw hole is a spring seat 57/58, preferably a flat bottomed one, in which a spring, being preferably a coil spring, is inserted. The purpose of such spring is to counteract the action of the respective adjustment screws 53/54 against the mobile unit 37. As shown on FIG. 11, each adjustment screw head 63 may also feature a peripheral slot, around the screw head 63, in which a rubber or other flexible material o-ring 50 is inserted to prevent water and other contaminants from penetrating inside the lighting assembly 1 through the threaded screw hole 51/52. As shown on FIGS. 11 and 12, a retaining ring 55 may be inserted in a peripheral slot of the respective adjustment screws 53/54, inside of the housing 3, to prevent the adjustment screw 53/54 from accidentally failing off and/or to limit its travel. The tip of the adjustment screw 53/54 is preferably rounded in order to minimize friction, as well as wear and tear, when the adjustment screw 53/54 is rotated against the mobile unit 37. The respective coil springs to be inserted in each of the respective spring seats 39, located on the opposite side of the respective adjustment screws 53/54, are preferably oriented along an axis that is parallel to that of the adjustment screw 53/54, so that the spring action directly counteracts that of the adjustment screw 56. When an adjustment screw 53/54 is rotated towards the mobile unit 37, the adjustment screw 53/54 pushes the mobile unit 37, and the latter pivots as mentioned above. When the adjustment screw 53/54 is rotated in the opposite direction, the coil spring located opposite of the adjustment screw 53/54 pushes the mobile unit 37 towards the screw 53/54, causing the mobile unit 37 to similarly rotate, but in the opposite direction.

Many other desirable and advantageous features of this invention will become apparent from the foregoing disclosure. Moreover, while this disclosure explains important aspects of this invention in considerable detail for purposes of illustration, it will be understood by those skilled in the art that many of these details may be varied without departing from the spirit and scope of the invention.

What is claimed is:

1. A windage and elevation control mechanism comprising:

a longitudinal and lateral mobile unit adapted to receive a device to be adjusted, the mobile unit having two aligned protrusions located respectively on longitudinal opposite sides thereof; and a receiving unit defining a cavity adapted to receive the mobile unit, the cavity being defined by facing surfaces having complimentary channels adapted to receive the protrusions of the mobile unit, whereby windage and elevation of the device is controlled by adjusting the mobile unit with respect to the receiving unit.

2. The windage and elevation control mechanism of claim 1, wherein the complimentary channels comprise:

a first socket adapted to receive one of the protrusions and being adapted to be in contact with a spherical part of the one of the protrusions in at least three points of contact defining an arc having more than 180 degrees; and a second socket adapted to receive another one of the protrusions, the second socket defining a curved channel adapted to securely maintain the mobile unit upon lateral and longitudinal movement of the mobile unit.

3. The windage and elevation control mechanism of claim 1 further comprising a fixed unit, the fixed unit comprising a retaining mechanism for retaining the mobile unit within the fixed unit while allowing longitudinal and lateral movement therebetween.

4. The windage and elevation control mechanism of claim 1, further comprising an adjusting mechanism, the adjusting mechanism being affixed to the receiving unit: and the mobile unit so as to adjust and control longitudinal and lateral movement of the mobile unit with respect to the fixed unit.

5. The windage and elevation control mechanism of claim 1, wherein the device is a laser.

6. The windage and elevation control mechanism of claim 1, wherein the mechanism is integrated into a lighting assembly.

7. The windage and elevation control mechanism of claim 6, wherein the lighting assembly comprises:

a principal light source, capable of projecting light outwardly;

at least one secondary light source; and a focusing element adapted to focus light emanating from the principal light source and adapted to let light emanating from the at least one secondary light source pass through the focusing element.

8. The windage and elevation mechanism of claim 7, wherein the principal light source is a Light Emitting Diode (LED).

9. The windage and elevation mechanism of claim 8, wherein the LED is provided with a heat sink device.

10. The windage and elevation mechanism of claim 9, wherein the heat sink device serves as a mounting plate for at least one of the plurality of secondary light sources.

11. The windage and elevation mechanism of claim 10, wherein the lighting assembly further comprises thermally insulating sleeves inserted between the heat sink device and the secondary light sources.

12. The windage and elevation mechanism of claim 9, wherein the single heat sink device is adapted for dissipating heat from the principal and at least one secondary light sources.

13. The windage and elevation mechanism of claim 9, wherein the heat sink device comprises a tab, and the focusing element comprises a registration notch adapted to mate with the tab, to ensure proper positioning of the focusing element.

14. The windage and elevation mechanism of claim 13, wherein the heat sink device is adapted for dissipating heat from the principal and at least one secondary light sources, the focusing element is a collimator, one of the secondary light sources serves as the tab, and a channel provided by the collimator serves as the registration notch.

15. The windage and elevation mechanism of claim 13, wherein the heat sink device is adapted for dissipating heat from the principal and at least one secondary light sources, the focusing element is a reflector, one of the secondary light sources serves as the tab, and an aperture provided by the reflector serves as the registration notch.

16. The windage and elevation mechanism of claim 9, wherein the heat sink device comprises a recess adapted to receive a printed circuit board containing circuitry required to drive the principal and secondary light sources.

17. The windage and elevation mechanism of claim 9, wherein the principal light source is a low profile LED, and the heat sink device defines at least one bevel adapted to position the focusing element in close proximity to the low profile LED.

18. The windage and elevation mechanism of claim 7, wherein the focusing element is a collimator.

19. The windage and elevation mechanism of claim 7, wherein the collimator has a rear face shaped in such a way that an appendix thereof forms a smaller collimator for the secondary light source.

20. The windage and elevation mechanism of claim 7, wherein the focusing element is a reflector.

21. The windage and elevation mechanism of claim 7, wherein one of the secondary light sources is a laser diode.

22. The windage and elevation mechanism of claim 7, wherein the lighting assembly further comprises:

a housing having an opening; and a battery level indicator located within the housing, the battery level indicator being visible through the opening.

23. The windage and elevation control mechanism of claim 1, wherein the cavity for receiving the windage and elevation control mechanism is provided on the heat sink device of a lighting assembly.

* * * * *